US006394912B1

(12) United States Patent
Nakamura et al.

(10) Patent No.: US 6,394,912 B1
(45) **Date of Patent: *May 28, 2002**

(54) SOLID GOLF BALL

(75) Inventors: Atsushi Nakamura; Hisashi Yamagishi; Takashi Maruko; Yutaka Masutani, all of Chichibu (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/466,800

(22) Filed: Dec. 20, 1999

(30) Foreign Application Priority Data

Jul. 9, 1999 (JP) ..... 11-195815

(51) Int. Cl.[7] ..... A63B 37/04; A63B 37/06; A63B 37/00; A63B 37/08

(52) U.S. Cl. ..... 473/371; 473/351; 473/373; 473/374; 473/370

(58) Field of Search ..... 473/351, 367, 473/370, 371, 373, 374, 376, 377

(56) References Cited

U.S. PATENT DOCUMENTS

| | | | | | |
|---|---|---|---|---|---|
| 5,439,227 | A | * | 8/1995 | Egashira et al. | 273/228 |
| 5,733,205 | A | * | 3/1998 | Higuchi et al. | 473/376 |
| 5,743,816 | A | * | 4/1998 | Ohsumi et al. | 473/376 |
| 5,772,531 | A | * | 6/1998 | Ohsumi et al. | 473/376 |
| 5,967,907 | A | * | 10/1999 | Takemura et al. | 473/373 |
| 6,071,201 | A | * | 6/2000 | Maruko | 473/373 |
| 6,254,495 | B1 | * | 7/2001 | Nakamura et al. | 473/371 |
| 6,271,296 | B1 | * | 8/2001 | Nakamura et al. | 524/423 |

FOREIGN PATENT DOCUMENTS

| | | |
|---|---|---|
| JP | 4-55077 | 9/1992 |
| JP | 7-194735 | 8/1995 |
| JP | 2674627 | 7/1997 |
| JP | 11-417 | 1/1999 |

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A solid golf ball comprises a solid core and a cover of at least one layer, the solid core having a multilayer construction which includes a center core and an outer core layer enclosing the center core. The center core is composed primarily of a thermoplastic resin or elastomer, and has a diameter of 3–18 mm and a Shore D hardness of 15–50. The outer core layer has a Shore D hardness near the interface thereof with the center core which is 1–15 units higher than the Shore D hardness of the center core. The ball has a good feel, excellent durability and good distance.

10 Claims, 1 Drawing Sheet

SOLID GOLF BALL

BACKGROUND OF THE INVENTION

1. Field of the Invention

The present invention relates to a multilayer golf ball which has a good durability to repeated impact with a golf club, a good feel when hit and improved distance.

2. Prior Art

A variety of multi-piece golf-ball constructions, including three-piece and four-piece balls, have been developed over the past few years in order to improve ball performance.

The practice is known of balancing a soft feel with good resilience in multi-piece golf balls by giving the ball a hardness distribution across its respective layers (core, intermediate layer and cover) in such a way as to retain both properties. In particular, a number of patents have been described on techniques for softening the core in order to achieve a soft feel (see, for example, JP-B 4-55077, JP 2674627, and JP-A 7-194735).

The cores of the golf balls disclosed in these patents all have a diameter of about 30 mm, or at least about 20 mm. Softening the core significantly lowers its resilience, which must then be compensated for by increasing the hardness of the intermediate layer and cover, to provide a reasonable resilience for the ball as a whole. However, increasing the hardness of these layers gives the ball a poor feel. In addition, stress concentration due to differences in hardness arises at the interface between the soft core and the hard intermediate layer, causing the layers to separate. JP-A 11-417 discloses a core provided with an inner layer of relatively small diameter. Yet, here too, there exists a large difference in hardness between the inner layer and the intermediate layer that has been formed around and encloses the inner layer, resulting in interfacial adhesion problems such as interlayer separation, and poor durability due to rubber fissuring in the intermediate layer.

SUMMARY OF THE INVENTION

It is therefore an object of the present invention to provide a solid, multilayer golf ball which has excellent durability to repeated impact with a golf club, a good feel when hit and increased distance.

The invention provides a solid golf ball comprising a solid core and a cover of at least one layer that encloses the solid core. The solid core has a multilayer construction which includes a center core and an outer core layer that encloses the center core. The center core is composed primarily of a thermoplastic resin or elastomer, and has a diameter of 3 to 18 mm and a Shore D hardness of 15 to 50. The outer core layer has a Shore D hardness near the interface thereof with the center core which is 1 to 15 units higher than the Shore D hardness of the center core.

In the solid golf ball of the present invention, the outer core layer is typically made of a rubber composition composed primarily of cis-1,4-polybutadiene and has a thickness of 1 to 16 mm. Preferably, at least one layer of the cover is harder than the outer core layer, and at least one layer of the cover is composed primarily of an ionomer resin. The center core typically has a specific gravity of 0.9 to 1.4.

The invention is directed to a solid golf ball comprising a solid core enclosed in a cover, wherein the solid core has both a center core and an outer core layer enclosing the center core. It has been found that by forming the center core to a small diameter, setting the Shore D hardness at the surface of the center core at from 15 to 50, and setting the Shore D hardness difference between the center core and the inside surface of the outer core layer within a specific range, the ball can be endowed with an improved durability to repeated impact with a golf club, a good feel and increased distance. It has also been found that using a resin material having a relatively low Shore D hardness in the center core greatly facilitates the grinding step, making it possible to efficiently produce small-diameter center cores. Moreover, the decline in the resilience due to the use of a resin material in the center core is relatively small for the ball as a whole because of the small diameter of the center core.

BRIEF DESCRIPTION OF THE DRAWING

The objects, features and advantages of the invention will become more apparent from the following detailed description.

The only FIGURE.

DETAILED DESCRIPTION OF THE INVENTION

Figure 1:
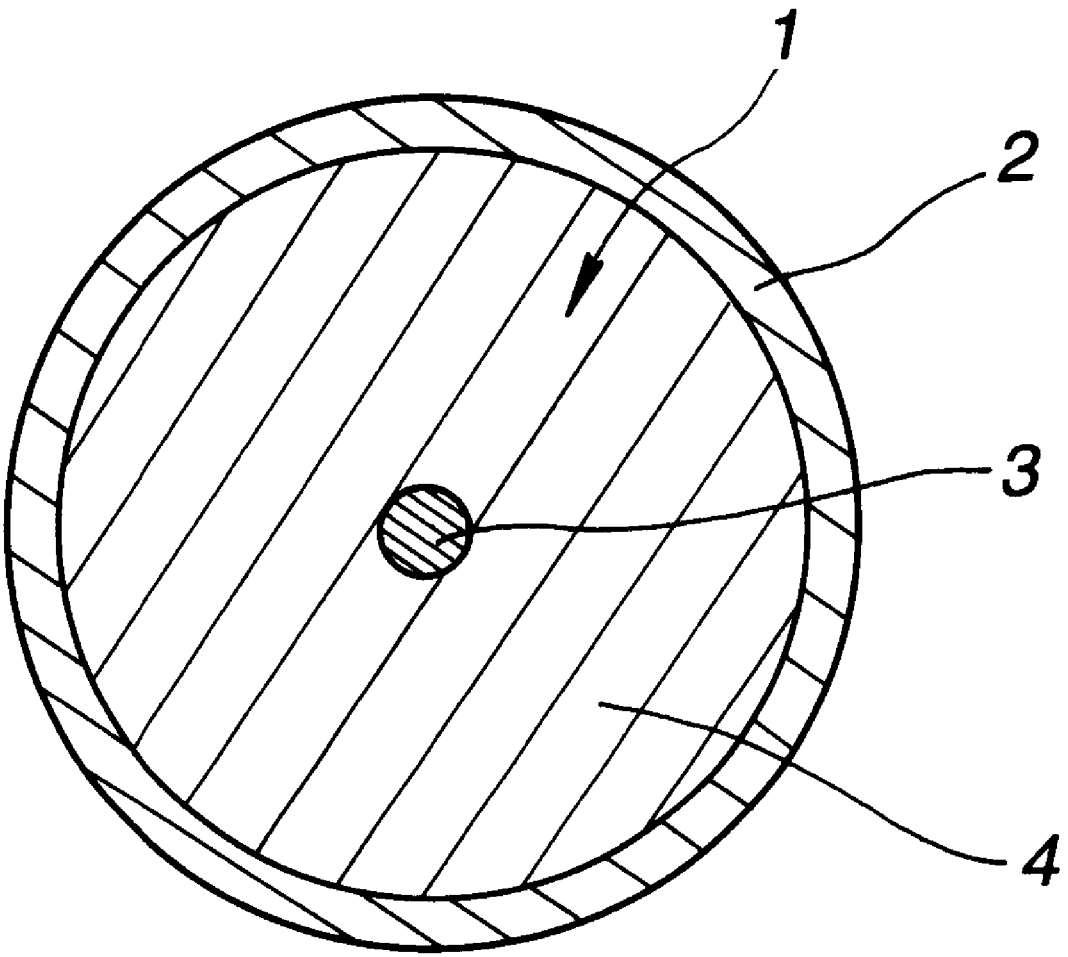
FIG. 1 is a sectional view showing a solid golf ball according to one embodiment of the invention.

Referring to FIG. 1, the solid golf ball of the invention is illustrated as comprising a solid core 1 enclosed within a cover 2. The solid core 1 has a center core 3 of smaller diameter than in the prior art, and an outer core layer 4 which encloses the center core 3 and is itself enclosed by the cover 2. The cover 2 is shown as a single layer in FIG. 1, but may be composed of two, three or more layers, if necessary.

The center core 3 in the present invention is not made of a rubber composition as in prior-art golf balls. Rather, it is composed primarily of a thermoplastic resin or elastomer, examples of which include ionomer resins, thermoplastic polyamide elastomers and thermoplastic polyester elastomers. Exemplary commercial products of this type include Surlyn (ionomer resins manufactured by E.I. DuPont de Nemours and Co.), Himilan (ionomer resins manufactured by DuPont-Mitsui Polychemicals Co., Ltd.), Amilan (thermoplastic polyamide elastomers manufactured by Toray Industries, Inc.), Rilsan (thermoplastic polyamide elastomers manufactured by DuPont-Toray Co., Ltd.), and Hytrel (thermoplastic polyester elastomers manufactured by DuPont-Toray Co., Ltd.).

If desired, an inorganic filler such as barium sulfate, titanium dioxide or zinc oxide may be blended as a specific gravity modifier in the resin material. Typically, the amount of filler blended is not more than 40 parts by weight, and preferably not more than 38 parts by weight, per 100 parts by weight of the base. Too much inorganic filler may lower the workability of the resin material during production of the center core.

The center core can be produced from a material composed primarily of the above thermoplastic resin or thermoplastic elastomer by a known process such as injection molding. The center core must have a diameter of at least 3 mm, although the diameter is preferably at least 3.5 mm, more preferably at least 4 mm, even more preferably at least 5 mm, and most preferably at least 8 mm. The upper limit in the center core diameter is 18 mm, preferably 16 mm, and most preferably 15 mm. A center core with too small a diameter fails to achieve the intended effect, whereas too large a diameter adversely affects the resilience of the ball and causes rubber fissuring in the surrounding layer, resulting in poor ball durability.

The center core has a Shore D hardness of at least 15, preferably at least 18, more preferably at least 22, and most preferably at least 25. The upper limit in the Shore D hardness is 50, and preferably 48. Too low a hardness gives the ball poor resilience, whereas a hardness that is too high results in a hard feel. The Shore D hardness of the center core, as used herein, refers to measurements obtained in accordance with ASTM D-2240.

The specific gravity of the center core is not subject to any particular limitation, although a specific gravity of 0.90 to 1.40, preferably 0.95 to 1.35, and most preferably 1.00 to 1.30, is generally recommended. Too low a specific gravity would make it necessary to increase the specific gravity of the rubber material used in the outer core layer and compromise the resilience of the ball. On the other hand, a specific gravity higher than the foregoing range would require the addition of too much filler to the center core composition, which can adversely affect moldability.

The outer core layer 4 around the center core 3 is preferably made of a rubber composition to more easily achieve good ball resilience. Alternatively, use can be made of a thermoplastic resin or elastomer, suitable examples of which include ionomer resins, thermoplastic polyamide elastomers and thermoplastic polyester elastomers.

When used as the outer core layer, the rubber composition is preferably one comprising polybutadiene as a base as in conventional golf ball cores. The use of 1,4-polybutadiene having a cis structure content of at least 40% is especially suitable. Where desired, other suitable rubber components such as natural rubber, polyisoprene rubber or styrene-butadiene rubber may be compounded in the polybutadiene. The resilience of the ball can be improved by increasing the proportion of rubber components. The other rubber components may be compounded in amounts of up to 10 parts by weight per 100 parts by weight of the polybutadiene.

A crosslinking agent may be blended in the rubber composition. Exemplary crosslinking agents are the zinc and magnesium salts of unsaturated fatty acids (e.g., zinc methacrylate, zinc acrylate), and ester compounds (e.g., trimethylpropane methacrylate). Zinc acrylate is especially preferred for achieving a high resilience. The crosslinking agent is preferably included in an amount of about 10 to 40 parts by weight per 100 parts by weight of the base rubber.

A vulcanizing agent is generally compounded in the rubber composition. It is recommended that the vulcanizing agent include a peroxide. Examples of suitable peroxides include commercially available products such as Perhexa 3M (manufactured by Nippon Oils and Fats Co., Ltd.). The amount of vulcanizing agent included in the rubber composition is preferably from about 0.6 to 2 parts by weight per 100 parts by weight of the base rubber.

If necessary, other suitable ingredients may also be added to the rubber composition, including antioxidants and fillers such as zinc oxide or barium sulfate for adjusting the specific gravity. The amount of such specific gravity modifiers blended in the composition is typically from about 1 to 30 parts by weight per 100 parts by weight of the base rubber.

If the outer core layer is made of a rubber composition, production of the layer may be carried out by using a known method to vulcanize and cure the rubber composition. For example, one highly suitable method is a two-step process in which the rubber composition is first subjected to primary vulcanization (semi-vulcanization) in a mold to form a pair of hemispherical cups. A pre-formed center core is then placed in one of the hemispherical cups, the other cup is closed over this, and secondary vulcanization (full vulcanization) is carried out.

The outer core layer may be made of a single layer or a plurality of layers. If it is made of two or more layers, the other layer or layers may be made of a similar rubber composition or may be made primarily of a resin, although use of a similar rubber composition is preferred. The outer core layer is preferably adjusted to such a thickness that the diameter of the solid core 1 comprising the center core 3 and the outer core layer 4 is preferably from 34.0 to 41.0 mm, and especially from 34.5 to 40.0 mm.

In the practice of the invention, it is critical for the outer core layer side at the interface between the center core and the outer core layer to have a higher Shore D hardness than the center core side. Specifically, the outer core layer side must have a Shore D hardness that is from 1 to 15 units higher. Preferably, the difference in Shore D hardness is at least 2 units, but not more than 13 units, and further preferably not more than 10 units. A center core which is so soft as to make the hardness difference at the interface with the outer core layer excessive tends to result in not only a loss of energy and decreased resilience characteristics, but also a poor durability. The Shore D hardness of the outer core layer is determined by cutting the golf ball in half and taking the measurement on the smooth cut face.

The golf ball of the invention is made by enclosing the solid core 1 with a cover 2 composed of one or more layers. A known cover stock material may be used, suitable examples of which include ionomer resins, balata rubber, and polyurethane-, polyamide- and polyester-based thermoplastic elastomers. Of these, ionomer resins are especially preferred. The cover is preferably formed using a conventional process such as injection molding.

The thickness or gage of the cover is not critical although this is generally from 0.8 to 4.3 mm, preferably from 1.0 to 3.5 mm, and most preferably from 1.5 to 2.5 mm. When the cover is composed of two or more layers, the overall thickness of the constituent layers should fall within the above range. A cover which is too thin would reduce the durability of the ball, while excessive thickness would compromise the feel.

Preferably, at least one layer of the cover is harder than the outer core layer. Most often, the cover has a Shore D hardness of 40 to 70, and preferably from 50 to 68.

As in conventional golf balls, the golf ball of the invention has numerous dimples formed on the surface of the cover. The total number of dimples is preferably from 350 to 500, more preferably from 370 to 480, and most preferably from 390 to 450. The dimples may have a geometrical arrangement that is octahedral or icosahedral, for example. Nor is the dimple pattern limited to a circular pattern, the use of any other suitable pattern, such as a square, hexagonal, pentagonal or triangular pattern, also being acceptable.

The golf ball of the invention should have a diameter and weight which conform with the Rules of Golf. That is, the ball should generally have a diameter large enough to keep it from passing through a ring with an inside diameter of 42.67 mm. Preferably, the diameter is from 42.67 mm to 42.75 mm. The ball should generally have a weight of not more than 45.93 grams, and preferably from 45.2 to 45.8 grams.

There has been described a solid golf ball which provides a good feel when hit with a golf club, excellent durability to repeated impact, and good distance characteristics.

EXAMPLES

Examples of the invention and comparative examples are given below by way of illustration, and are not intended to limit the invention.

EXAMPLES AND COMPARATIVE EXAMPLES

In most of the examples, center cores having the specifications shown in Table 1 were produced by injection molding the resin materials formulated as shown in Table 1 in a mold. In Comparative Examples 2 and 3, center cores were produced by vulcanizing the rubber compositions formulated as shown in Table 1.

An outer core layer was formed in each example by working the rubber composition shown in Table 1 using a roll mill, then subjecting the mixed composition to primary vulcanization (semi-vulcanization) in a mold at 130° C. for 6 minutes, thereby producing a pair of hemispherical cups. The pair of cups was closed as the outer core layer over the surface of the center core, then subjected to secondary vulcanization (full vulcanization) at 155° C. for 15 minutes, giving a solid core having a two-layer construction.

The cover stock shown in Table 1 was injection molded about the solid core in each example to form a cover bearing dimples of the same shape, arrangement and number, yielding a solid golf ball having the characteristics shown in Table 1.

In Table 1, the Shore D hardness values given for the center core and the cover were obtained in accordance with ASTM D-2240. The Shore D hardness values given for the outer core layer were obtained in each case by cutting the ball in half and measuring the hardness at a given point on the cut face.

The properties of the resulting golf balls were measured and evaluated. Using a swing robot, the ball was hit with a driver at a head speed of 45 m/s and the carry and total distance were measured.

Workability

The workability of the center core material during the mixing step was rated as follows.

Good: Easy to mix

Fair: Mixing operation was not entirely smooth

Poor: Difficult to mix

Feel

Three professional golfers rated the feel of the golf balls obtained in each example according to the following criteria. Results shown in the table are averaged ratings.

Good: Appropriately soft, yet solid feel

Fair: Ordinary feel

Poor: Hard feel

Durability

The ball was hit consecutively 50 times with a driver mounted on a swing robot. Durability was evaluated by measuring the initial velocity because this value drops off sharply when fissures form in the rubber at the interior of the ball. The ball was rated "Poor" when a drop of initial velocity was found and "Good" when no drop was found until the last strike.

The results are presented in Table 1.

TABLE 1

| | | | | EX 1 | EX 2 | EX 3 | EX 4 | EX 5 | CE 1 | CE 2 | CE 3 |
|---|---|---|---|---|---|---|---|---|---|---|---|
| Solid core | Center core | Formulation (pbw) | Hytrel 3046 (polyester)[1)] | 100 | 100 | | | | | | |
| | | | Hytrel 4001 (polyester)[1)] | | | 100 | 100 | | | | |
| | | | Hytrel 4701 (polyester)[1)] | | | | | 100 | | | |
| | | | Rilsan BMNO (polyamide)[2)] | | | | | | 100 | | |
| | | | Barium sulfate | 9 | 13 | 10 | 10 | | 42 | | |
| | | | cis-1,4-Polybutadiene | | | | | | | 100 | 100 |
| | | | Zinc oxide | | | | | | | 5 | 5 |
| | | | Barium sulfate | | | | | | | 68 | 38 |
| | | | Zinc diacrylate | | | | | | | 20 | 5.0 |
| | | | Dicumyl peroxide | | | | | | | 1.2 | 1.2 |
| | | Parameters | Diameter (mm) | 15.0 | 10.0 | 8.0 | 6.0 | 5.0 | 22.0 | 10.0 | 32.0 |
| | | | Weight (g) | 2.03 | 0.62 | 0.32 | 0.14 | 0.08 | 7.42 | 0.73 | 19.73 |
| | | | Specific gravity | 1.15 | 1.18 | 1.20 | 1.20 | 1.20 | 1.33 | 1.40 | 1.15 |
| | | | Shore D hardness (ASTM-D-2240) | 31 | 31 | 41 | 41 | 47 | 83 | 48 | 25 |
| | | | Workability during mixing | good | good | good | good | good | fair | poor | good |
| | Outer core layer | Formulation (pbw) | cis-1,4-Polybutadiene | 100 | 100 | 100 | 100 | 100 | 100 | 100 | 100 |
| | | | Zinc oxide | 5 | 5 | 5 | 5 | 5 | 5 | 5 | 5 |
| | | | Barium sulfate | 29.0 | 33.0 | 21.0 | 20.5 | 23.0 | 11.5 | 21.0 | 26.0 |
| | | | Zinc diacrylate | 10.0 | 5.0 | 28.0 | 30.0 | 27.0 | 36.5 | 27.0 | 30.0 |
| | | | Dicumyl peroxide | 1.2 | 1.2 | 1.2 | 1.2 | 1.2 | 1.2 | 1.2 | 1.2 |
| | | Parameters | Primary vulcanization conditions | 130° C./6 min | 130° C./6 min | 130° C./6 min | 130° C./6 min | 130° C./6 min | 130° C./6 min | 130° C./6 min | 130° C./6 min |
| | | | Secondary vulcanization conditions | 155° C./15 min | 155° C./15 min | 155° C./15 min | 155° C./15 min | 155° C./15 min | 155° C./15 min | 155° C./15 min | 155° C./15 min |
| | | | Weight (g) (including center core) | 35.0 | 35.0 | 35.0 | 35.0 | 35.0 | 35.0 | 35.0 | 35.0 |
| | | | Diameter (mm) | 38.5 | 38.5 | 38.5 | 38.5 | 38.5 | 38.5 | 38.5 | 38.5 |
| | Interfacial hardness (Shore D) | | Center core | 31 | 31 | 41 | 41 | 41 | 83 | 48 | 28 |
| | | | Inside of outer core layer | 40 | 35 | 53 | 55 | 54 | 60 | 54 | 55 |
| | | | (Outer core layer) − (Center core) | 9 | 4 | 12 | 14 | 13 | −23 | 6 | 27 |
| Cover | Formulation (pbw) | | Himilan 1605 (ionomer)[3)] | | | 50 | 50 | | | 50 | |
| | | | Himilan 1706 (ionomer)[3)] | | | 50 | 50 | | | 50 | |

TABLE 1-continued

| | | | EX 1 | EX 2 | EX 3 | EX 4 | EX 5 | CE 1 | CE 2 | CE 3 |
|---|---|---|---|---|---|---|---|---|---|---|
| | | Himilan 1557 (ionomer)[3)] | 50 | 50 | | | 50 | 50 | | 50 |
| | | Himilan 1601 (ionomer)[3)] | 50 | 50 | | | 50 | 50 | | 50 |
| | Parameters | Shore D hardness | 58 | 58 | 62 | 62 | 58 | 58 | 62 | 58 |
| | | Thickness (mm) | 2.1 | 2.1 | 2.1 | 2.1 | 2.1 | 2.1 | 2.1 | 2.1 |
| Ball | Parameters | Diameters (mm) | 42.7 | 42.7 | 42.7 | 42.7 | 42.7 | 42.7 | 42.7 | 42.7 |
| | | Weight (g) | 45.3 | 45.3 | 45.3 | 45.3 | 45.3 | 45.3 | 45.3 | 45.3 |
| | HS = 45 m/s | Carry (m) | 215.0 | 214.5 | 215.5 | 213.5 | 212.0 | 209.5 | 210.0 | 211.0 |
| | | Total distance (m) | 231.0 | 229.5 | 230.0 | 231.5 | 229.0 | 225.0 | 228.0 | 229.0 |
| | | Feel | good | good | good | good | good | good | fair | good |
| | | Durability | good | good | good | good | good | poor | fair | good |

Japanese Patent Application No. 11-195815 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising a solid core and a cover of at least one layer that encloses the solid core, the solid core having a multilayer construction which includes a center core and an outer core layer that encloses the center core, wherein the center core consists essentially of a thermoplastic resin or a thermoplastic elastomer, and has a diameter of 3 to 16 mm and a Shore D hardness of 15 to 50, and the outer core layer is made of a rubber composition composed primarily of cis-1,4-polybutadiene and has a Shore D hardness near the interface thereof with the center core which is 1 to 15 higher than the Shore D hardness of the center core, and at least one layer of the cover is harder than the outer core layer.

2. The solid golf ball of claim 1 wherein at least one layer of the cover is composed primarily of an ionomer resin.

3. The solid golf ball of claim 1 wherein the center core has a specific gravity of 0.9 to 1.4.

4. The solid golf ball of claim 1 wherein the center core has a diameter of 3 to 10 mm.

5. The solid golf ball of claim 1 wherein the center core has a Shore D hardness of 15 to 48.

6. The solid golf ball of claim 1 wherein the outer layer has a Shore D hardness near the interface thereof with the center core which is 4 to 15 units higher than the Shore D hardness of the center core.

7. The solid golf ball of claim 1 wherein the center core has a diameter of at least 8 mm.

8. The solid golf ball of claim 1 wherein said center core has a Shore D hardness of at least 25.

9. The solid golf ball of claim 1 wherein said solid core has a diameter in the range of 34.5 to 40.0 mm.

10. The solid golf ball of claim 1 wherein said cover has a Shore D hardness in the range of 40 to 70.

* * * * *